US008397419B2

(12) United States Patent
Williams

(10) Patent No.: US 8,397,419 B2
(45) Date of Patent: Mar. 19, 2013

(54) ROTATABLE MOUNT FOR INTEGRATED RAIL SYSTEM AND METHOD FOR USING SAME

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 53 days.

(21) Appl. No.: 12/685,812

(22) Filed: Jan. 12, 2010

(65) Prior Publication Data

US 2011/0167701 A1 Jul. 14, 2011

(51) Int. Cl.
*F41C 27/00* (2006.01)

(52) U.S. Cl. ..... 42/90

(58) Field of Classification Search ..... 42/90, 94, 42/111, 124, 125, 128, 148, 85
See application file for complete search history.

(56) References Cited

U.S. PATENT DOCUMENTS

| | | | | | |
|---|---|---|---|---|---|
| 2,187,054 | A | * | 1/1940 | Redfield | 42/125 |
| 2,202,000 | A | * | 5/1940 | Gray | 42/124 |
| 2,447,892 | A | * | 8/1948 | Baliff | 362/396 |
| 2,775,806 | A | * | 1/1957 | Love | 24/271 |
| 2,826,848 | A | * | 3/1958 | Davies | 42/71.01 |
| 3,260,001 | A | * | 7/1966 | Weaver | 42/124 |
| 3,877,166 | A | * | 4/1975 | Ward | 42/127 |
| 4,026,055 | A | * | 5/1977 | Weast | 42/124 |
| 4,079,970 | A | * | 3/1978 | Brett | 285/136.1 |
| 4,299,044 | A | * | 11/1981 | Johannsen | 42/127 |
| 4,429,468 | A | * | 2/1984 | Jimenez et al. | 42/124 |
| D283,433 | S | * | 4/1986 | Bechtel | D22/110 |
| 4,756,111 | A | * | 7/1988 | Lapier | 42/128 |
| 5,417,002 | A | * | 5/1995 | Guerra | 42/72 |
| 5,471,777 | A | * | 12/1995 | McDonald | 42/132 |
| 7,454,858 | B2 | * | 11/2008 | Griffin | 42/71.01 |
| 7,562,484 | B2 | * | 7/2009 | Kim | 42/114 |
| 7,578,089 | B1 | * | 8/2009 | Griffin | 42/71.01 |
| 7,698,847 | B2 | * | 4/2010 | Griffin | 42/71.01 |
| 8,056,277 | B2 | * | 11/2011 | Griffin | 42/71.01 |
| 2006/0026888 | A1 | * | 2/2006 | Cheng et al. | 42/146 |
| 2006/0179701 | A1 | * | 8/2006 | Mossberg et al. | 42/77 |
| 2006/0191183 | A1 | * | 8/2006 | Griffin | 42/72 |
| 2007/0266612 | A1 | * | 11/2007 | Kim | 42/127 |
| 2007/0271832 | A1 | * | 11/2007 | Griffin | 42/72 |
| 2009/0223105 | A1 | * | 9/2009 | Griffin | 42/72 |
| 2009/0277069 | A1 | * | 11/2009 | Delmonico | 42/105 |
| 2009/0313874 | A1 | * | 12/2009 | Griffin | 42/72 |
| 2011/0023348 | A1 | * | 2/2011 | Karagias | 42/124 |
| 2011/0167699 | A1 | * | 7/2011 | Griffin | 42/72 |

* cited by examiner

*Primary Examiner* — Jonathan C Weber
(74) *Attorney, Agent, or Firm* — Harris Beach PLLC

(57) ABSTRACT

An accessory support for a firearm having a longitudinal barrel, the accessory support comprising an annular body attachable to the barrel or to a rail on the barrel and including an inner surface wherein a portion of the inner surface includes a curved surface, an accessory mounting structure coupled to the annular body for receiving an accessory to the firearm, and a coupling mechanism attached to the annular body to fixedly attach the accessory support to the firearm or rail, wherein the curved surface includes a circumferentially-extending curved recess having opposing lateral surfaces for engaging mating protrusions of a rail mounted on the firearm barrel.

10 Claims, 8 Drawing Sheets

ROTATABLE MOUNT FOR INTEGRATED RAIL SYSTEM AND METHOD FOR USING SAME

FIELD OF THE INVENTION

This application relates to accessories for firearms. More particularly, embodiments according to this application relate to accessory supports that mount to rail systems that may include one or more accessory rails.

BACKGROUND OF THE INVENTION

An operator must grip a firearm on or adjacent the barrel to stabilize the firearm during operation. Rail systems can be provided to attach accessories that are available to aid in the proper or enhanced operation of firearms. Further, rail systems can prevent items from directly attaching to the barrel, which can alter the barrel slightly and can adversely affect the accuracy of the firearm. Also, rail systems can protect the hand from the heat of the barrel.

Rail systems and/or firearm accessories add weight to the firearm. Accessories and/or accessory mounting devices need to mount securely, easily, and quickly to the rail systems and certain accessories need power to operate. Further, accessory mounting devices must be constructed ruggedly and to withstand heavy use. In addition accessory mounting devices need to be cheap, fast, simple, and accurately manufactured.

SUMMARY OF THE INVENTION

Accordingly, it is an aspect of this application to address in whole or in part, at least the foregoing and other deficiencies in the related art.

It is another aspect of this application to provide in whole or in part, at least the advantages described below.

It is an object of this application to provide a rotatable accessory mount for use with a firearm, a rail system of a firearm, accessory rail, and/or methods for using the same. It is an object of this application to provide a secure and circumferentially moveable accessory mount and methods thereof. It is an object of this application to provide removable rotatable accessory mounts and/or methods of using the same. It is an object of this application to provide a support device that slidingly moves between a plurality of positions, where an inner surface engages outer surfaces between longitudinally spaced projections of a firearm rail system at each of the plurality of positions and methods thereof. It is an object of this application to provide a rotatable mount including a curved inner surface with a recess or race or cavity that engages curved lower surfaces between and side surfaces of spaced radial projections of a rail system. The curved inner surface can include a recess corresponding to a spaced radial projection of the rail system.

In one embodiment, an accessory support for a firearm can include an annular body including an inner surface, a portion of the inner surface includes a curved surface, where an accessory mounting structure coupled to the annular body, and a coupler to fixedly attach the accessory support to firearm.

In another embodiment, a mount apparatus for an integrated rail system can include a mount body including an inner surface, an outer surface, a first side surface to connect the inner and outer surfaces, and a second side surface to connect the inner and outer surfaces, an accessory mount coupled to a surface of the mount body, and an engagement portion of the mount apparatus includes a curved portion of the inner surface of the mount body.

In yet another embodiment, a method can include forming a mount structure including a curved surface, and attaching the mount structure to an accessory rail system for a firearm using the curved surface.

BRIEF DESCRIPTION OF THE DRAWINGS

Novel features that are characteristic of the embodiments of the application are set forth with particularity in the claims. The application itself may be best be understood, with respect to its organization and method of operation, with reference to the following description taken in connection with the accompanying drawings in which:

DESCRIPTION OF EMBODIMENTS

Figure 1:
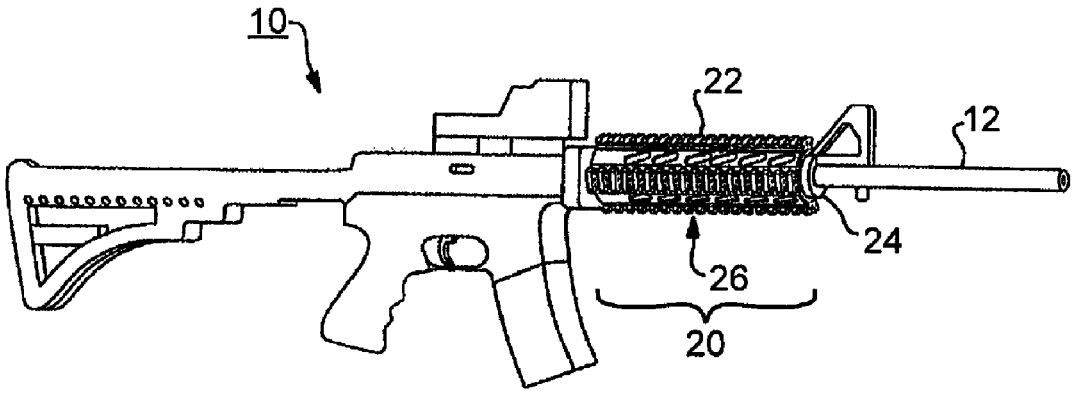
FIG. 1 is a diagram that shows a perspective exterior view of an exemplary firearm and rail system.

Referring to FIG. 1, firearm 10 has a barrel 12 extending beyond an exemplary rail system 20. Rail system 20 can include top rail 22, side rails 24, and bottom rail 26. Rail system 20 can be mounted on firearm 10 by various structures and methods known to one skilled in the art. Rail system 20 can be an integrated accessory rail system that can be extruded as a single piece having each element integrally formed therewith. Alternatively, rail system 20 can be manufactured in a plurality of pieces and assembled before or assembled simultaneously when mounting directly or indirectly to firearm 10. While rail system 20 can be mounted on a rifle as shown in FIG. 1, exemplary rail systems can be mounted on substantially any firearm. Further, embodiments of accessory mounts according to the application can be mounted on substantially any firearm.

Any or all of top rail 22, side rails 24, and bottom rail 26 can be referred to herein as "rail assembly." Additionally, while top rail 22, side rails 24, and bottom rail 26 are illustrated carried by rail system 20, some, or all may be omitted as desired. Further, for example, exemplary rails, accessory rails, and/or various rail assemblies described herein such as rail system 20 (and/or rail system 30, rail system 400) can adhere to all the critical dimensions of MIL-STD 1913, and/or Picatinny rail, which is hereby incorporated by reference in its entirety.

Figure 2:
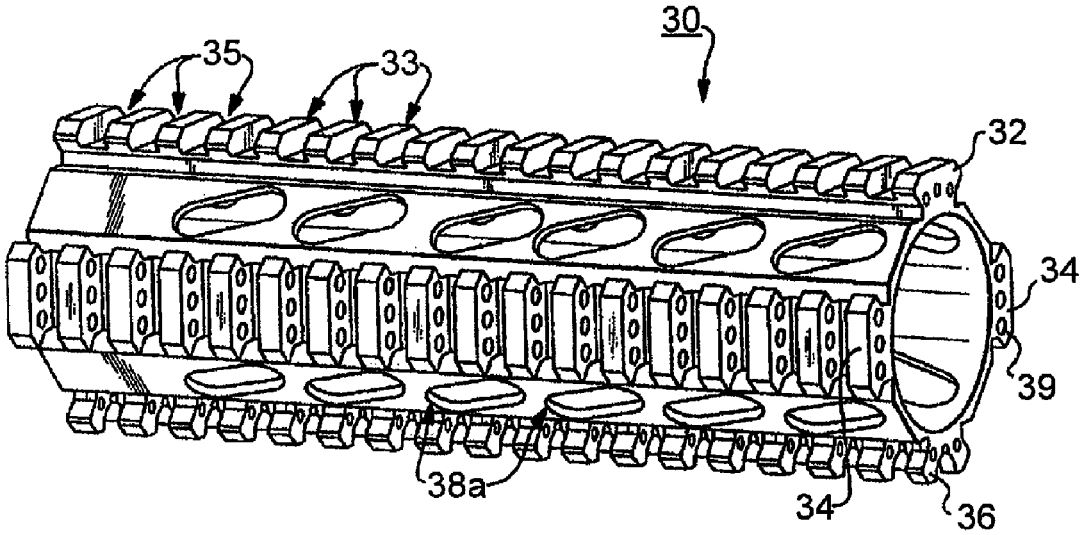
FIG. 2 is a diagram that shows a perspective exterior view of exemplary rail system for use with embodiments of the application.

Referring now to FIG. 2, an exemplary rail system 30 can include top accessory rail 32, side accessory rails 34, or bottom accessory rail 36. The following descriptions of exemplary rail system 30 include a description of the various accessory rails. Those skilled in the art will understand that rail system 30 can be used without accessory rails, and conversely, accessory rails can be employed on other rail systems, hand guard systems, or firearms in general. Rail system 30 can include a tubular body 38 that can be spaced from, but surround or cover a portion/majority of barrel 12 of a firearm. Tubular body 38 may be fabricated, for example, by extrusion and subsequent milling. Top accessory rail 32 can be formed manufactured with tubular body 38 and can be used to mount rail system 30 to firearm 10 (e.g., at an upper mount of firearm 10). Rail system 30 can, for example, engage a barrel nut of barrel 12 for support. Alternative or additional support can be provided to rail system 30 and/or top accessory rail 32, if present.

In the event that one or all of top accessory rail 32, side accessory rails 34, or bottom accessory rail 36 are used without tubular body 38, they may be attached to a firearm using another rail system or by structures other than a rail system (e.g., attachment rings, hand guards, or other mounting devices). As described herein, structure mounting one or all of the top accessory rail 32, side accessory rails 34, and/or bottom accessory rail 36 can be included in the "mounting structure," which is intended to include any structures mounting one or all of the top accessory rail 32, side accessory rails 34, or bottom accessory rail 36 on a firearm, including tubular body 38. Further, one or all of top accessory rail 32, side accessory rails 34, and bottom accessory rail 36 and the mounting structure for the rails can be considered to be in the "rail system" as described herein.

Referring to FIG. 2, openings 38*a* (e.g., longitudinal slots) can be formed in tubular body 38, between top accessory rail 32, side accessory rails 34, and bottom accessory rail 36 to reduce weight and/or increase air flow between tubular body 38 and the firearm and/or barrel 12. Openings 38*a* can be formed crossing or within accessory rails.

A plurality of equally spaced transverse ribs 33 can be formed on a portion, a majority, or substantially the entire length of top accessory rail 32, side accessory rails 34, and/or bottom accessory rail 36 separated or interspaced by a plurality of corresponding recesses 35. As shown in FIG. 2, the recesses 35 of the rail system 30 can have a flat planar bottom surface between adjacent tabs or ribs 33. Transverse ribs 33 can be used to mount accessories to a firearm and can reduce or prevent movement (e.g., forward, sideways, or rearward) of accessories attached thereto.

Figure 3:
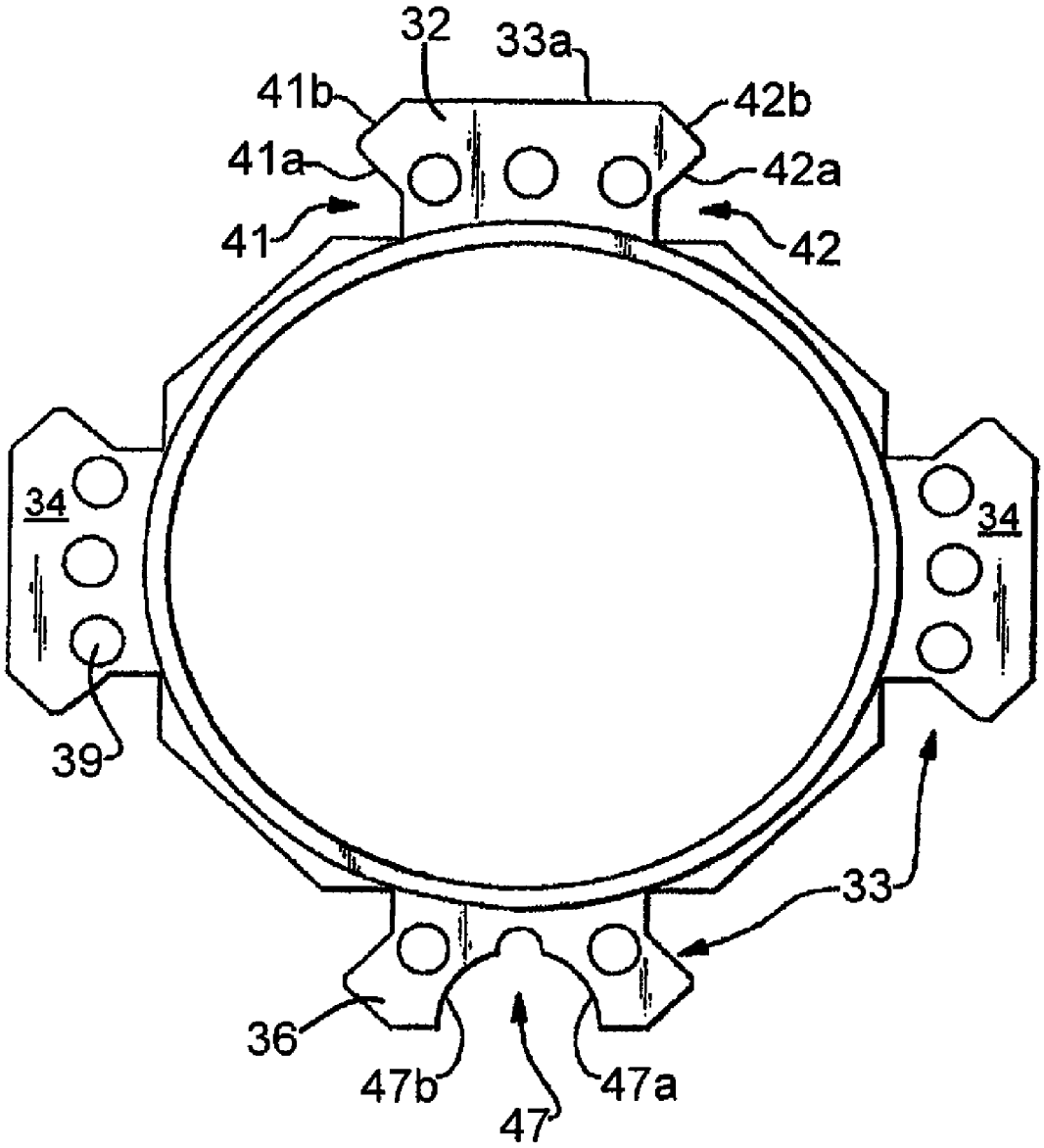
FIG. 3 is a diagram that shows a front end view of an exemplary rail system shown in FIG. 2.

Referring to FIG. 3, a front view of rail system 30 is illustrated. Top accessory rail 32 and side accessory rails 34 are substantially identical; therefore, only top accessory rail 32 will be described in detail herein. Bottom accessory rail 36 is similar to top accessory rail 32 but includes a central longitudinal groove 47 and/or openings 38*a*. It is understood that central groove 47 can have different cross-sections (e.g., stepped, angled, tiered, or the like) to provide additional internal referencing surfaces.

Referring to FIG. 3, top accessory rail 32 can include at least first (e.g., lower) external referencing surfaces 41 and 42, which can be defined by opposing longitudinal side cuts or grooves 41 and 42, respectively. Second (e.g., upper) external referencing surfaces 41*b* and 42*b* adjoin first external referencing surfaces 41*a* and 41*b*. A third (e.g. top) referencing surface 33*a* can join second referencing surfaces 41*b* and 42*b*. Additional external or internal referencing surfaces may be included for an accessory rail. For example, optional internal referencing surfaces 47*a* and 47*b* can be defined by central longitudinal cut or groove 47.

In top accessory rail 32, side accessory rails 34, or bottom accessory rail 36, one or more longitudinally extending conduits (e.g., passageways, tubes) 39 can be provided as shown in FIG. 3. Exemplary conduits 39 can pass through one or more of ribs 33, recesses 35, tubular body 38 and/or longitudinal slots 38*a*, 38*b*. Further, conduits 39 can pass through at least one transverse rib 33, a plurality of transverse ribs 33, a majority of transverse ribs 33, or all transverse ribs 33 in a corresponding accessory rail.

Figure 4:
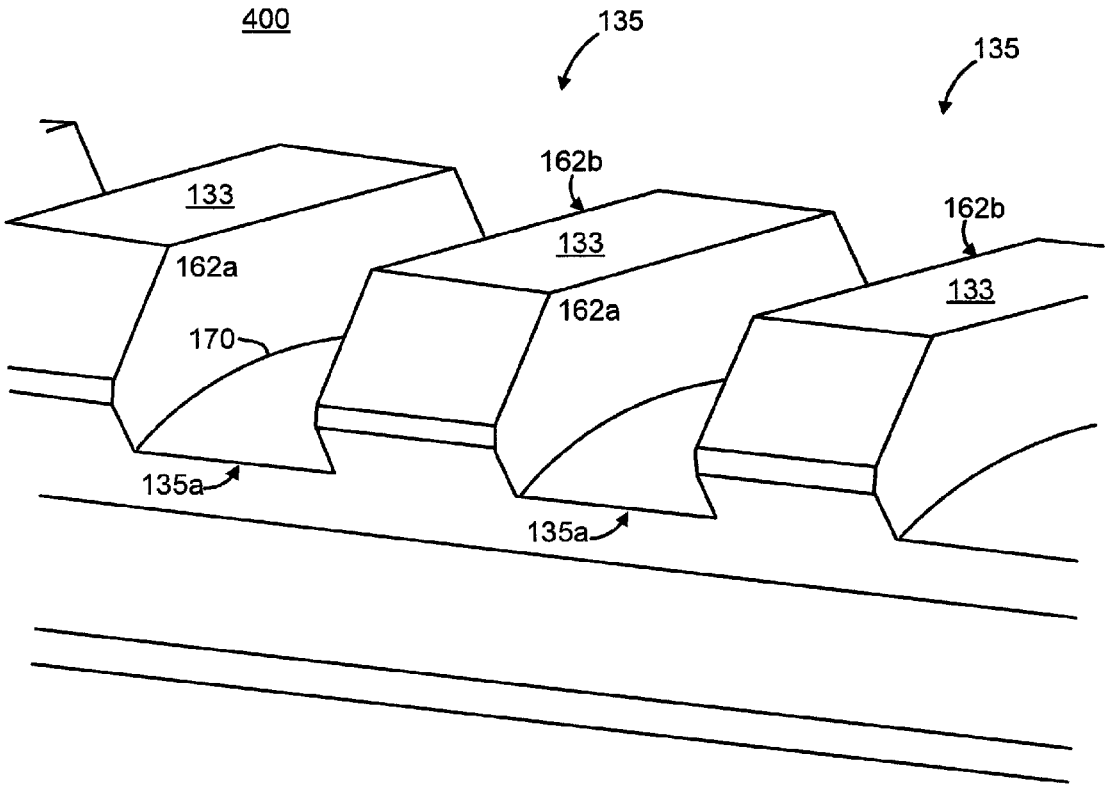
FIG. 4 is a diagram that shows a perspective view of another exemplary rail system having a curved surface between tabs of an accessory rail for use with embodiments of the application.

Referring to FIG. 4, exemplary rail system 400 is similar to exemplary rail system 30. However, a bottom surface 135*a* between transverse tabs 133 is curved. As shown in FIG. 4, transverse tabs 133 can include surfaces 162, which can be used to mount accessories. Surfaces 162 can be substantially vertical and can include first lateral surfaces 162*a* and second opposing lateral surfaces 162*b* (e.g., forward lateral surfaces and back lateral surfaces 162*b*), which can define recess 135 therebetween.

As shown in FIG. 4, a bottom surface 135*a* of recess 135 can be curved. For example, the bottom surface 135*a* can have the shape of a portion of a cylindrical surface. Further, an intersection between bottom surface 135*a* of recess 135 and lateral surfaces 162*a* or 162*b* forms a curved or non-linear line 170. In contrast, FIG. 2 illustrates of the rail system 30 having a flat lower surface of the recess 35.

Referring to FIG. 3, exemplary accessory mounting structures can be detachably held by one or more of external referencing surfaces 41*a*, 41*b*, 42*a*, 42*b* or internal referencing surfaces 47*a*, 47*b*. Various types of accessory mounting structures known to one skilled in the art can be used with rail system 30.

Figure 5:
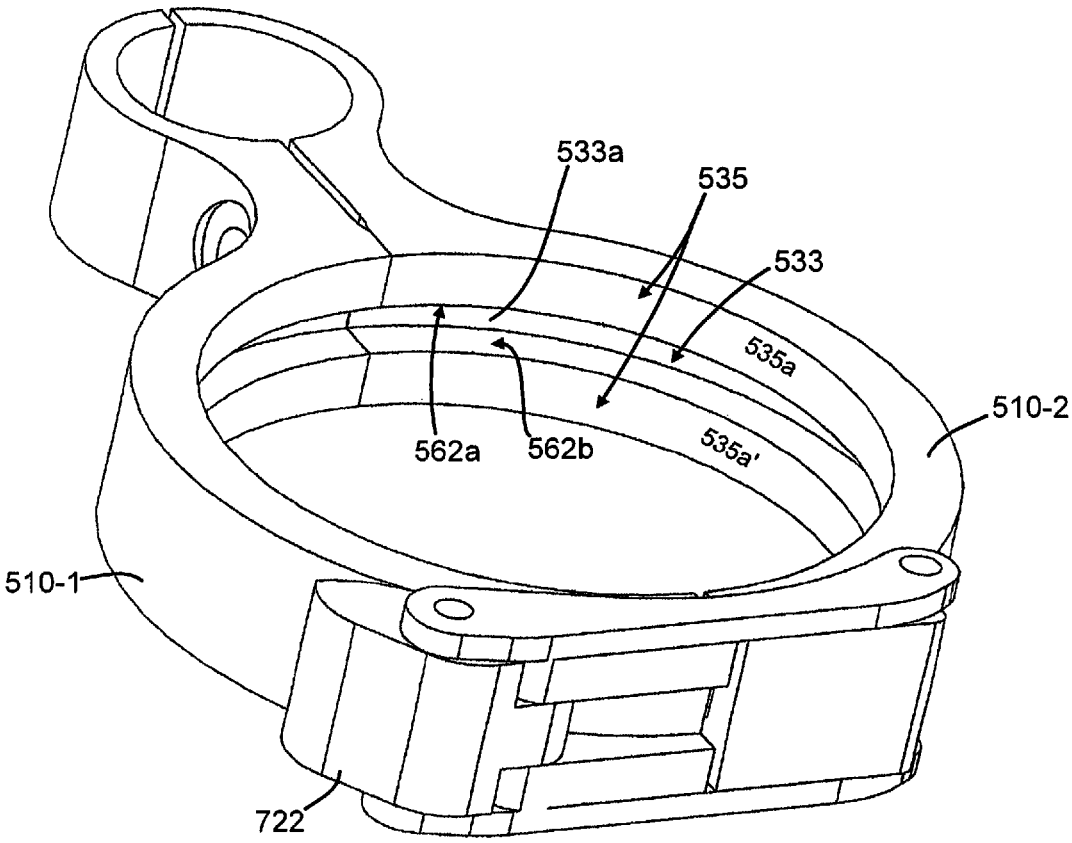
FIG. 5 is a diagram that shows a perspective view of an exemplary embodiment of an accessory mount according to an embodiment of the application.

Referring to FIG. 5, an exemplary embodiment of a rotatable accessory mount is illustrated. As shown in FIG. 5, rotatable mount structure 500 includes a curved lower (e.g., inner radial surface) surface 535. For example, the curved lower surface 535 has a cylindrical shaped that is substantially continuous. In one embodiment, the curved lower surface 535 includes first and second contacting surfaces 535*a*, 535*a*' separated by at least one recess 533. The recess 533 can include a first lateral wall 562*a* and an opposing second lateral wall 562*b* that can be separated by connecting surface 533*a*. The curved lower surface 535 can be generally configured to interlock (e.g., frictionally fit) with recesses (e.g., 35, 135) between tabs (e.g., 33, 133) in an integrated rail system or an accessory rail of a rail system. In one embodiment, the first and second contacting surfaces 535*a*, 535*a*' can implement a matching curvature (e.g., radius or radial circumference) to the curved bottom surface 135*a*. Further, the recess 533 can be generally configured to interlock (e.g., frictionally fit) with a corresponding rib 33 (e.g., lateral surfaces 162*a*, 162*b*) from an integrated rail. Alternatively, the recess 533 can be dimensioned to prevent contact between the mount structure 500 (e.g., the recess 533) and longitudinal or external surfaces or (e.g., 41, 42) a top surface of the ribs 33.

Figure 6:
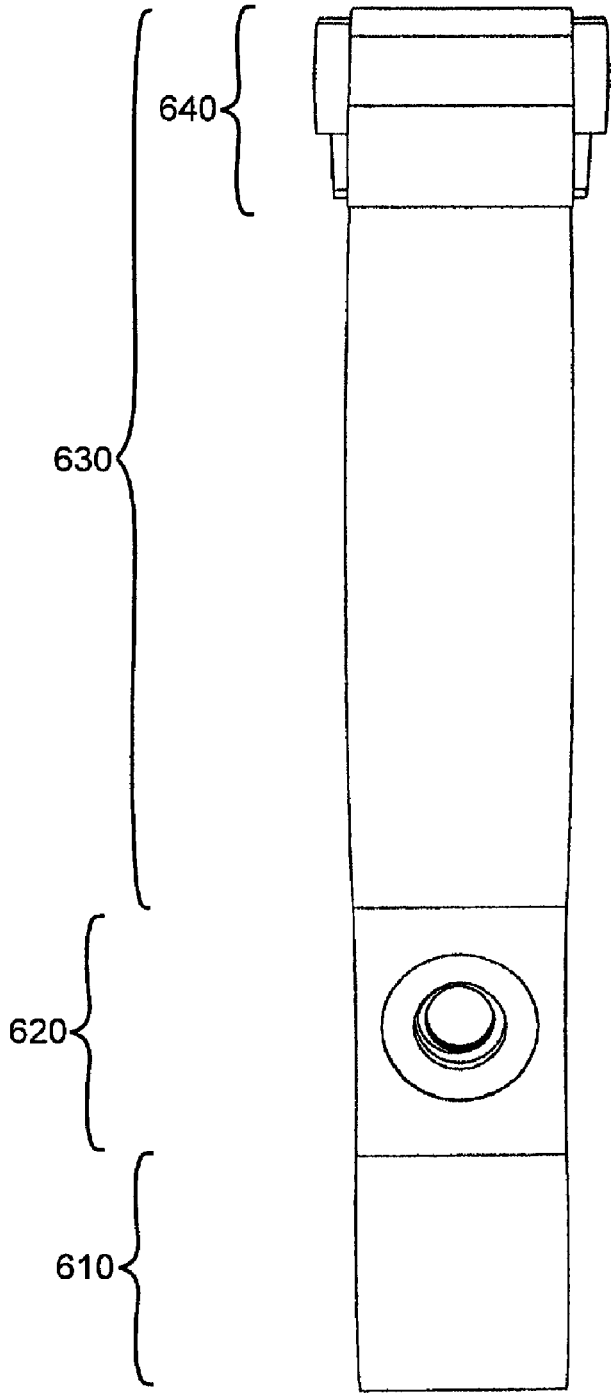
FIG. 6 is a diagram that shows a side view of the exemplary embodiment of the accessory mount shown in FIG. 5.

FIG. 6 is a diagram that illustrates a side view of the mount structure 500 of FIG. 5. As shown in FIG. 6, the mount structure 500 can include an accessory mounting portion 610, a second fastener or second locking mechanism 620, an annular section 630 and a first fastener or first locking mechanism 640. In one embodiment, the second locking mechanism 620 is optional. In one embodiment, the second locking mechanism can be included in the annular section 630.

As shown in FIG. 6, the accessory mounting portion 610 can be formed to accommodate any selected standard accessory size or configuration. For example, the accessory mounting portion 610 can have a standard sized footprint, which can cooperatively affix at least one standard accessory type. As shown in FIG. 5, the accessory mounting portion 610 can have a standard sized (e.g., 1", ¾", ½") cylindrical footprint, which can satisfy at least one standard accessory type including a helmet camera. However, the accessory mounting portion 610 is not intended to be so limited. For example, other accessories including but not limited to cameras, sights, scopes, flashlights, lasers, infrared devices, recording devices or the like, which can be fit to a standard accessory mount instantiated by accessory mounting portion 610, can be used. Further, the accessory mounting portion 610 can have alternative standard mounting configurations or shapes (e.g., including rectangular, polygonal, etc.) As shown in FIG. 5, the accessory mounting portion 610 can be used to mount any cylindrical accessory with an outer diameter of 0.7 to 1.1 inches (18 to 28 mm). Further, accessories mounted to the accessory mounting portion 610 can be powered by internal sources (e.g., batteries) or external sources using adaptors or cables to supply the power (e.g., via connections to external power sources or batteries).

As shown in FIGS. 5-8, the first fastener or first locking mechanism 640 can be formed to releasably fasten a first elongated side piece 510-1 and a second elongated side piece 510-2 together. As shown in FIG. 5, the first fastener 640 can be mounted at a distal end of the rotatable mount structure 500 from the accessory mounting portion 610. However, embodiments of the application are not intended to be so limited. For example, the first fastener 640 can be at any point around the curved lower surface 535 or the annular section 630.

In one embodiment, the first fastener 640 can operate to reciprocally move between first and second positions. In both the first and second positions of the first fastener 640, the curved lower surface 535 can frictionally engage the rail system at recesses 35, 135. However, in the second position, the mount structure 500 can not be moved (e.g., using unassisted manual force or without damaging the rail system or the mount structure 500), and in the first position, the mount structure 500 can rotatably move (e.g., using manual force). For example, in the first position the mount structure 500 can move around a longitudinal axis of the annular section 630 and/or the longitudinal axis of the integrated rail.

In the first position, the first fastener 640 can remain connected to both the first elongated side piece 510-1 and the second elongated side piece 510-2. Alternatively, in the first position, the first fastener 640 can remain connected to only one of the first and second elongated side pieces. In either exemplary configuration, the first position of the first fastener 640 can produce sufficient dimensional fit or frictional force to support the rotatable mount structure 500 in the rail system to remain in place unless moved by force applied by a user. Alternatively, in the first position of the first fastener 640, a frictional fit to a corresponding rail system can be negligible so that the mount structure 500 slides freely (e.g., from gravity) in the first position of the first fastener 640.

In one embodiment, in the first position of the first fastener 640, the second engagement points 512-1, 512-2 (FIG. 8) of the first elongated side piece 510-1 and the second elongated side piece 510-2 are separated by a gap 514 therebetween. In the second position of the first fastener 640, the second engagement points 512-1, 512-2 of the first elongated side piece 510-1 and the second elongated side piece 510-2 can be adjacent or a size of the gap 514 is reduced relative to the first position of the first fastener 640.

In one embodiment, the first lateral wall 562*a* and/or the opposing second lateral wall 562*b* can frictionally engage corresponding lateral walls 162*a* and 162*b* of the tabs 133 in both of the first and the second positions of the first fastener 640. Alternatively, the first lateral wall 562*a* and the second lateral wall 562*b* can frictionally engage the lateral walls 162*a*, 162*b* of the tabs 133 in only the second position of the first fastener 640.

Figure 7:
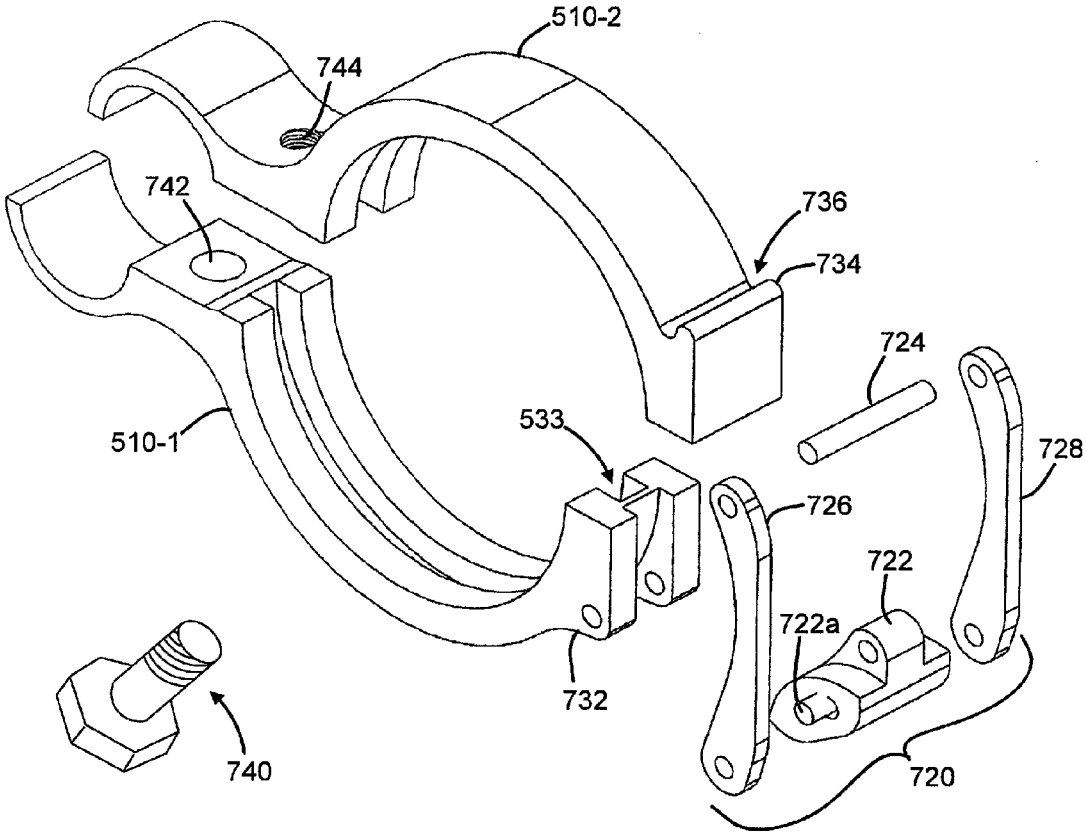
FIG. 7 is a diagram that shows an exploded perspective view of the exemplary embodiment of the accessory mount shown in FIG. 5.
Figure 8:
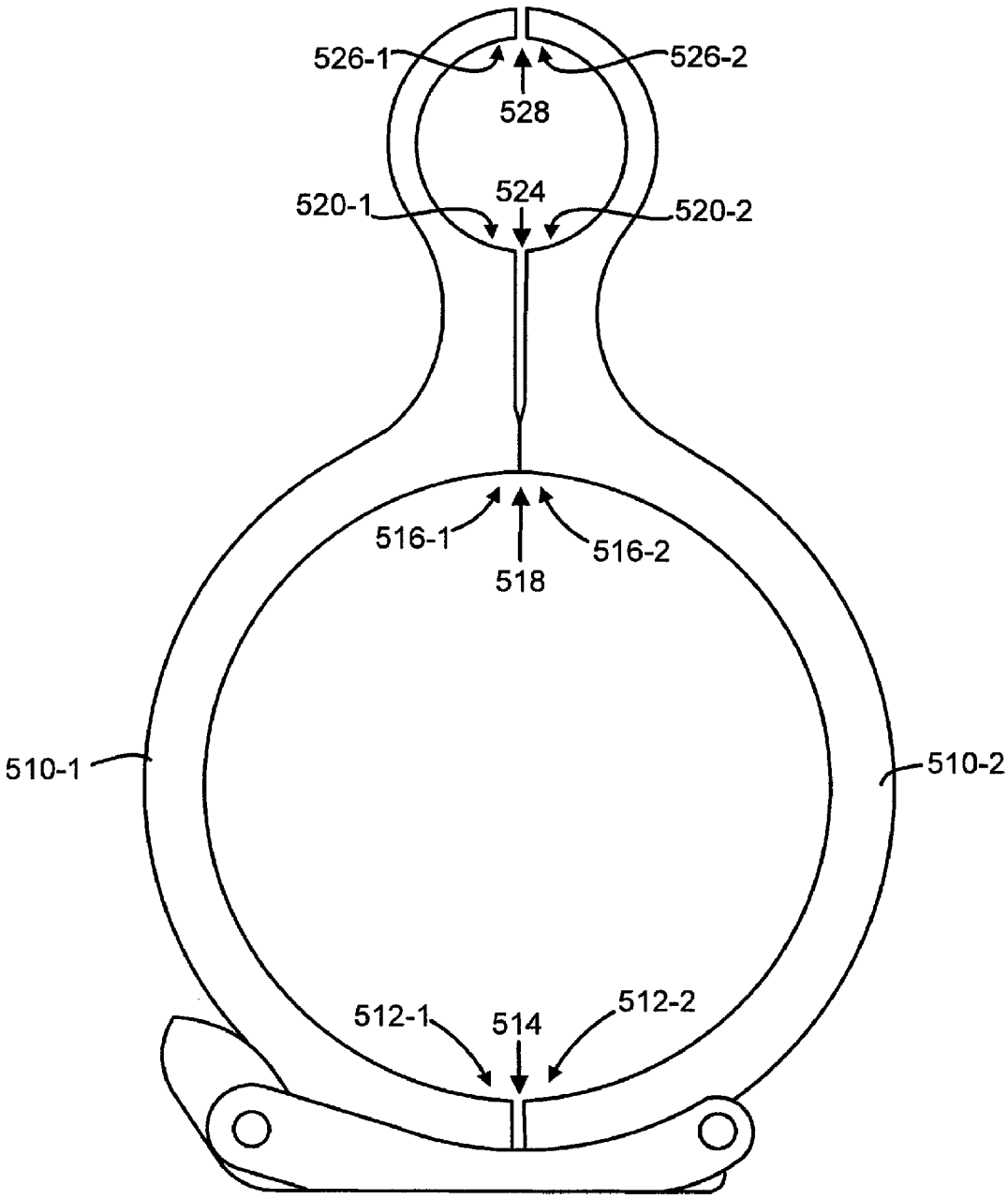
FIG. 8 is a diagram that shows a top view of the exemplary accessory mount according to an embodiment of the application.

As shown in FIG. 7, in one embodiment, the first fastener 640 can include a hinge 720 tangentially attached to upper surfaces (e.g., outer surfaces) of the first and second elongated side pieces 510-1, 510-2. In one embodiment, the hinge 720 can include latch 722 including first pin 722*a*, second pin 724, first link 726 and second link 728. The first link 726 and the second link 728 are pivotably connected to only the first pin 722*a* or both the first pin 722*a* and the second pin 724. The first pin 722*a* passes through corresponding holes in first radial projections 732 of the first elongated side piece 510-1. The second elongated side piece 510-2 has second radial projections that form a lip 734 at an outer edge of a recess 736 configured to receive the second pin 724 when the mount structure 500 is attached to the integrated rail assembly. For example, the lip 734 can be configured to retain the second pin 724 in just the first position of the first fastener 640 or both the first and second positions of the first fastener 640.

As shown in FIGS. 5-8, the second fastener or second locking mechanism 620 can be formed to releasably fasten a first elongated side piece 510-1 and a second elongated side piece 510-2 together. As shown in FIG. 5, the second fastener 620 can be mounted between the annular section 630 and the accessory mounting portion 610. However, embodiments of the application are not intended to be so limited. For example, the second fastener 620 can be positioned in the annular section 630. The first fastener 640 and the second fastener 620 are spaced apart from each other on the first and second elongated side pieces 510-1, 510-2.

In one embodiment, the second fastener 620 can operate to reciprocally move between first and second positions. In both positions of the second fastener 620, the curved lower surface 535 can frictionally engage the lower surfaces of recess 35, 135. However, in the second position of the second fastener 620, an accessory (e.g., flashlight) mounted in the accessory mounting position 610 is rigidly or lockingly held and cannot be moved (e.g., using unassisted manual force or without breaking the mount structure 500). In the first position of the second fastener 620, the accessory (e.g., flashlight) can move. For example, in the first position of the second fastener 620, the accessory can be changed.

The second fastener 620 corresponds generally to and is intended to reciprocally hold together the first engagement points 516-1, 516-2 of the first elongated side piece 510-1 and the second elongated side piece 510-2, which are by are separated by a gap 518 therebetween. In the second position of the second fastener 620, the first engagement points 512-1, 512-2 of the first elongated side piece 510-1 and the second elongated side piece 510-2 are held together, adjacent or a size of the gap 518 is reduced relative to the first position of the second fastener 620. Alternatively, the first engagement points 516-1, 516-2 can be configured to touch in both positions of the second fastener 620 so that the first fastener 640 alone changes an inner circumferential size of the annular section 630 (e.g., 535).

In addition, in the first position of the second fastener 620, the third engagement points 522-1, 522-2 of the first elongated side piece 510-1 and the second elongated side piece 510-2 are separated by a gap 524 therebetween and fourth engagement points 526-1, 526-2 of the first elongated side piece 510-1 and the second elongated side piece 510-2 are separated by a gap 528 therebetween. In the second position of the second fastener 620, the third engagement points 522-1, 522-2 and the fourth engagement points 526-1, 526-2 of the first elongated side piece 510-1 and the second elongated side piece 510-2, respectively, can be adjacent or a size of the gap 524 and/or the gap 528 can be reduced relative to the first position of the second fastener 620.

As shown in FIG. 7, in one embodiment, the second fastener 620 can include a bolt 740 to pass through a corresponding hole 742 in the first elongated side pieces 510-1 and engage internal threads 744 in a receiving hole passing through the second elongated side piece 510-2. Alternatively, a nut can be used to reciprocally engage the bolt 740 in the second position of the second fastener 620 and release the bolt 740 in the first position of the second fastener 620. Other connecting structures are intended for and can be interchangeably used for the first and second fasteners.

In one embodiment, the mount structure 500 can include an alternate configuration for the curved lower (e.g., inner radial surface) surface 535 to provide additional contacting surfaces for the lower flat surface 35*a* shown in FIG. 2. For example, to controllable align to and provide the additional contacting surfaces with the lower flat surface 35*a* shown in FIG. 2, the curved lower surface 535 can include four flat portions (not shown) to correspond with the lower flat surfaces 35*a* on the top, sides and bottom rails. The four flat portions of the curved lower surface 535 can project into the annular section 630 and can have approximately the width of a top surface 33*a* of the rib 33. Alternatively, the curved lower surface 535 can include a multiple of four (e.g., eight, twelve, sixteen, etc.) flat portions to correspond with the lower flat surfaces 35*a* and to allow additional frictional contact when the mount structure 500 is not aligned directly with the accessory rails (e.g., top, side, or bottom rails) of a rail system, however, a width of the flat portions may be reduced. In another embodiment, the curved lower surface 535 can include a plurality of corner portions, each to align with one of the two ends of each of the lower flat surfaces 35*a*. Such exemplary corner portions in the curved lower surface 535 can project away from an interior of the annular section 630 and into the curved lower surface 535. Each connecting side forming the corner portion of the curved lower surface 535 can have a prescribed dimension. Further, the curved lower surface 535 can include additional corner portions (e.g., eight, ten, twelve, etc) to correspond with the lower flat surfaces 35*a* and to allow additional frictional contact when the mount structure 500 is not aligned directly with the accessory rails (e.g., top, side or bottom rails) of a rail system.

In one embodiment, the rotatable mount structure 500 can include an alignment indicator to indicate the accessory mounting portion 610 is accurately aligned with the corresponding accessory rail (e.g., top rail 32, side rails 34, or bottom rail 36). For example, the alignment indicator can be marking on the forward lateral face of the first and second elongated side piece 510-1, 510-2 in view of the operator. Alternatively, the alignment indicator could be a projection from the rail system that sufficiently engages a portion of the mount structure 500 to be detected or felt by the operator while the mount structure 500 is rotating about the integrated rail. In one embodiment, the alignment indicator can be a longitudinal projection on a top surface 33*a* of the rib 33 having a corresponding shape to the gap 514 so that as the mount structure 500 rotates around the integrated rail the projection slides into an out of the gap 514 to be detected by the operator. When the projection enters the gap 514 the accessory mounting portion 610 is accurately aligned with the opposite rail. Alternatively, the mount structure 500 can include an elastic projection that could engage an adjacent tab 133 (e.g., longitudinal or exterior surface 41, 42) where the accessory mounting position is accurately aligned. Other structures are possible and intended to be used for the alignment indicator.

Mount structure 500 can be fabricated, cast or molded of metal, such as aluminum, titanium, etc., or plastics as known to one skilled in the art.

Figure 9:
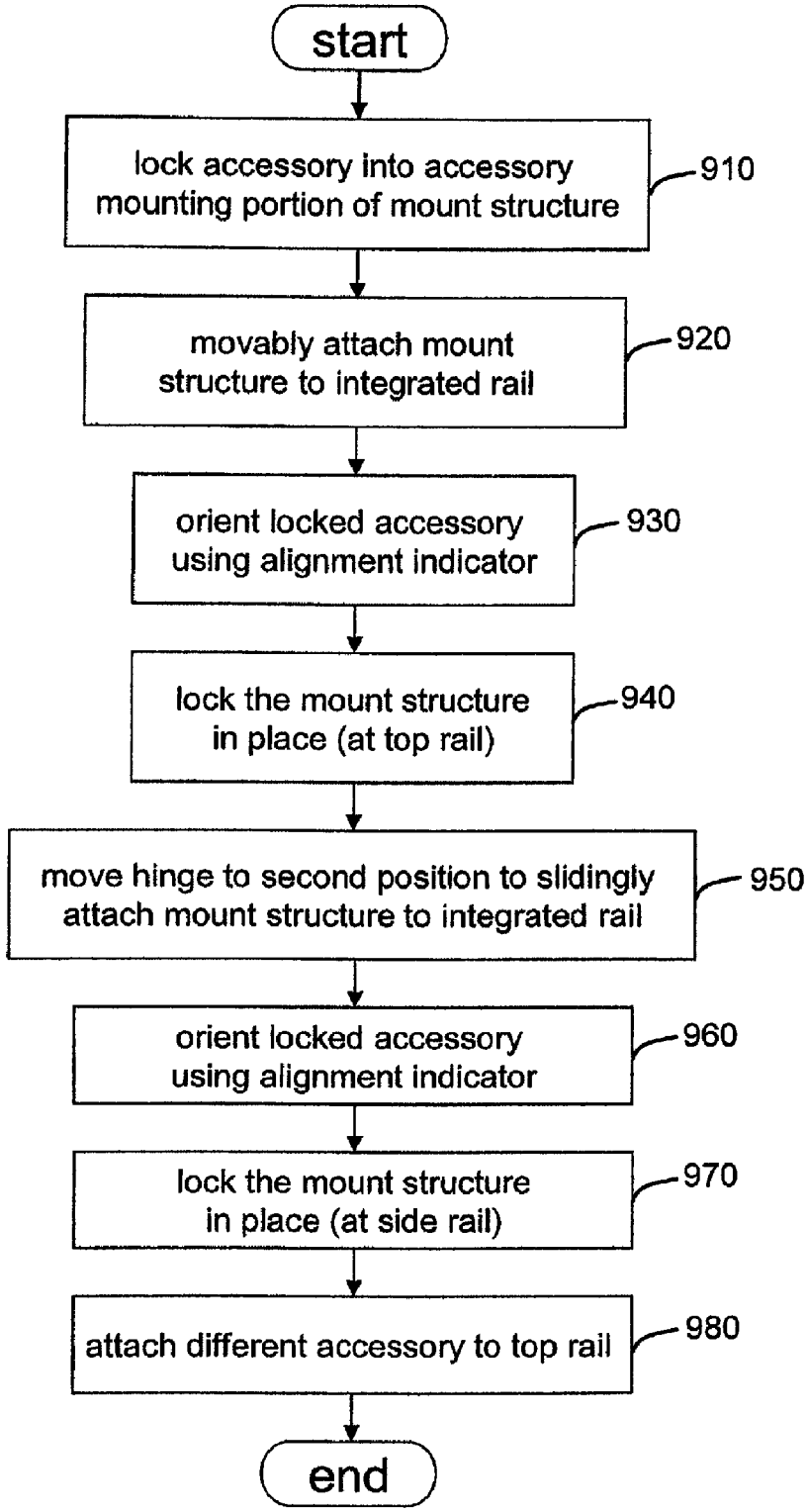
FIG. 9 is a diagram that shows a flowchart of an exemplary method to operate a mount structure according to an embodiment of the application.

Referring to FIG. 9, a flowchart of an exemplary method for attaching a mount structure to an integrated rail system according to embodiments of the application will now be described. The method for attaching a mount structure of FIG. 9, will be described using and can be applied to the mount structure 500; however, the method of FIG. 9 is not intended to be limited to the mount structure 500.

Referring to FIG. 9, after a process starts, a camera or flashlight can be mounted into the accessory mounting portion 610 and locked into place using the second fastener 620 (operation block 910). Then, the accessory mount structure (e.g., rotatable) 500 can be attached to an integrated rail assembly with the hinge 720 in the first position (operation block 920). The camera can be oriented to the top accessory rail 32 by the operator or using the alignment indicator of the mount structure 500 (operation block 930). The mount structure 500 can be locked in place by moving the hinge 720 or the latch 722 into its second or locking position (operation block 940). To mount a scope (e.g., different accessory) on the top rail 32, the operator can move the hinge 720 or the latch 722 to its first position and the locked camera can be rotated with the mount structure 500 to a side rail 34 (operation block 950), aligned to the side rail 34 (operation block 960), and locked into place by moving the hinge 720 to its second position (operation block 970). Then the scope can be attached to the top rail 32 and not be obstructed (operation block 980). From operation block 980, the process can end. Although described in sequence, it is understood that operations described in the method of FIG. 9 can be performed in various sequences or in parallel.

In one embodiment, the rotatable mount structure 500 can be quickly moved from an orientation of a mounted accessory to a first side rail 34 (e.g., left side) to an orientation of the mounted accessory to the opposite side rail 34 (e.g., right side). Switching the mounted accessory from one side of firearm to the other can reduce clearance needed for the firearm and operator when rounding a corner, entering a room, passing thorough a doorway, etc. by valuable inches depending on whether the operator is acting from the right side or the left side when the operation (e.g., entering the doorway) is performed.

In one embodiment, the mount structure 500 can include a curved surface for mounting to a firearm and a coupling mechanism. The coupling mechanism can move between a first position to rigidly attach the mount structure to the firearm, a second position to slidingly attach (e.g., rotational movement) the mount structure 500 to the firearm, and a third position to detach the mount structure from the firearm. The first and second position of the coupling mechanism can use the curved surface. The coupling mechanism for the mount structure can include a single fastener or a single locking mechanism. Alternatively, the coupling mechanism for the mount structure 500 can include at least two fasteners or two locking mechanisms.

In one exemplary rail system, a bottom surface of recesses formed between opposing lateral faces have a curved surface (e.g., a convex surface when viewed from a front/back perspective). The curvature of a bottom surface between opposing lateral faces can be related to the radial size of rail system unitary body. Reduced debris in the recess can result because the curved or sloped bottom surface can trap less debris and/or previously trapped debris will be forced or urged out of the recess by the slope or curvature.

Although grooves 41, 42, and/or 49 are illustrated as a single groove or cut, a plurality of cuts or grooves may be used, for example, to define various surfaces 41*a*, 41*b*. Further, longitudinal grooves 41 and/or 42 can define a plurality of additional external referencing surfaces, for example, a fourth external reference surface can be located between first and second external referencing surfaces 41*a* and 41*b* or 42*a* and 42*b*. Alternatively, additional external referencing surfaces can be below first external referencing surfaces 41*a* or 42*a*.

Although embodiments of the application have been described with respect to symmetric and separate first and second elongated side pieces, embodiments are not intended to be so limited. For example, exemplary mount structure embodiments can be formed as single integral piece. In one embodiment, the gap 518, the gap 524, and the gap 528 the accessory mounting portion 610 can be eliminated. In one embodiment, just the gap 524 and the gap 518 can be eliminated. In one embodiment, just the gap 528 can be eliminated. In one embodiment, the gap 528 can be replaced with a pivoting fastener such as a hinge. Further, the separate first and second elongated side pieces do not need to be symmetric. In one embodiment, the first elongated side piece could form more than half (e.g. ¾) of the annular section and the second elongated side piece can form less than half (e.g., ¼) of the annular section.

Although embodiments of the application have been described with respect to a hinge as a first fastener or locking mechanism, embodiments are not intended to be so limited. For example, the first fastener can be a coupler such as but not limited to a releasable connector, a hinge, a joint, a juncture, a pivot, a two position connector, a one-handed operational configuration. In addition, for example, the first fastener can be a coupler such as but not limited to a releasable connector, a hinge, a joint, a juncture, a pivot, a two position connector, or having a one-handed operational configuration.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been set forth, it will be understood that features and aspects that have been described with reference to each particular embodiment can be used with each remaining particularly set forth embodiment.

I claim:

1. A rotatable accessory support for a firearm having a rail system mounted on the firearm, the rail system comprising at least one transverse tab, the accessory support comprising:

a) a first elongated side piece comprising a first arcuate portion for clamping the accessory and a second arcuate portion for clamping the rail system;

b) a second elongated side piece comprising a first arcuate portion for clamping the accessory and a second arcuate portion for clamping the rail system, wherein the second arcuate portions of the first and second elongated side pieces each comprise opposing lateral surfaces defining a circumferential recess therebetween configured and adapted to receive at least one transverse tab of the rail system;

c) a first fastener for releasably attaching the second arcuate portions of the first and second elongated side pieces to the rail system; and d) a second fastener for attaching the first and second elongated side pieces, wherein the rotatable accessory support is circumferentially moveable around the rail system.

2. The support of claim 1 wherein the first elongated side piece and the second elongated side piece are disposed on opposite sides of a plane of symmetry.

3. The support of claim 1, wherein:

the second fastener attaches the first elongated side piece to the second elongated side piece in a region between the first arcuate portion and the second arcuate portion of each elongated side piece.

4. The support of claim 3, wherein the second fastener is an adjustable bolt wherein adjustment of the bolt retains an accessory between the first arcuate portion of the first elongated side piece and the first arcuate portion of the second elongated side piece.

5. The support of claim 1, wherein the first fastener is hinged from one of the first and second elongated side pieces.

6. The support of claim 1 wherein the first fastener comprises:

a) a first engagement protrusion extending from the first elongated side piece;

b) a second engagement protrusion extending from the second elongated side piece; and c) a hinging mechanism couplable between the first engagement protrusion and the second engagement protrusion.

7. The support of claim 6, wherein the hinging mechanism is adjustable to accommodate a plurality of rail systems having differing diameters.

8. The support of claim 1 wherein the first and second arcuate portions of the first and second elongate side pieces are cylindrical.

9. The support of claim 1 wherein the first fastener operates to reciprocally move between first and second positions on the rail.

10. The support of claim 9 wherein:

in both the first and second positions, the circumferential recess receives at least one traverse tab of the rail system, in the first position, the accessory support can rotatably move, and in the second position, the accessory support cannot be moved.

* * * * *